US011599067B2

(12) United States Patent
Kinoshita

(10) Patent No.: US 11,599,067 B2
(45) Date of Patent: Mar. 7, 2023

(54) ELECTRONIC TIMEPIECE AND CONTROL METHOD OF ELECTRONIC TIMEPIECE

(71) Applicant: Seiko Epson Corporation, Tokyo (JP)

(72) Inventor: Eiji Kinoshita, Matsumoto (JP)

(73) Assignee: SEIKO EPSON CORPORATION

( * ) Notice: Subject to any disclaimer, the term of this patent is extended or adjusted under 35 U.S.C. 154(b) by 469 days.

(21) Appl. No.: 16/798,568

(22) Filed: Feb. 24, 2020

(65) Prior Publication Data

US 2020/0272109 A1 Aug. 27, 2020

(30) Foreign Application Priority Data

Feb. 25, 2019 (JP) ..... JP2019-031332

(51) Int. Cl.
*G04R 20/04* (2013.01)
*G04G 7/00* (2006.01)
*G04R 40/06* (2013.01)

(52) U.S. Cl.
CPC ..... *G04R 20/04* (2013.01); *G04G 7/026* (2013.01); *G04R 40/06* (2013.01)

(58) Field of Classification Search
CPC ..... G04R 20/04; G04R 40/06; G04G 7/026
USPC ..... 368/47
See application file for complete search history.

(56) References Cited

U.S. PATENT DOCUMENTS 6,282,431 B1 * 8/2001 Konno ..... H04M 1/72451 455/425
8,504,026 B2 * 8/2013 Ito ..... H04W 48/18 370/332
2002/0181333 A1 12/2002 Ito et al.
2010/0317390 A1 12/2010 Rekimoto
2011/0280108 A1 * 11/2011 Honda ..... G04R 20/06 368/21
2015/0205263 A1 7/2015 Momose
2015/0268635 A1 * 9/2015 Kobayashi ..... G04C 9/00 368/107

(Continued)

FOREIGN PATENT DOCUMENTS

JP H11-136755 A 5/1999
JP 2001-337182 A 12/2001

(Continued)

*Primary Examiner* — Edwin A. Leon
*Assistant Examiner* — Kevin Andrew Johnston
(74) *Attorney, Agent, or Firm* — Harness, Dickey & Pierce, P.L.C.

(57) ABSTRACT

An electronic timepiece includes a communication unit receiving identification information for identifying a radio station from the radio station, a storage unit storing a database having, as a record, the identification information and time difference information indicating a time difference associated with the identification information, a timekeeping unit in which a set time difference being a time difference with respect to a reference time is set, a first time difference correction unit correcting the set time difference to the time difference information associated with the identification information received by the communication unit, an operation unit accepting user operation, a second time difference correction unit correcting the set time difference according to the operation, and an update processing unit updating the database by changing the time difference information to the set time difference corrected by the second time difference correction unit.

17 Claims, 11 Drawing Sheets

(56) References Cited

U.S. PATENT DOCUMENTS

| | | | | |
|---|---|---|---|---|
| 2016/0223994 | A1* | 8/2016 | Honda | G04R 20/02 |
| 2016/0246264 | A1 | 8/2016 | Nagareda | |
| 2017/0261944 | A1* | 9/2017 | Fujisawa | G04R 20/04 |

FOREIGN PATENT DOCUMENTS

| | | | |
|---|---|---|---|
| JP | 2009-085726 | A | 4/2009 |
| JP | 2013-130562 | A | 7/2013 |
| JP | 2016-156660 | A | 9/2016 |
| JP | 2018-109650 | A | 7/2018 |
| WO | 2008-047628 | A1 | 4/2008 |

* cited by examiner

41

| NO. | RADIO STATION INFORMATION | | | TIME ZONE INFORMATION | | | UPDATE TIME INFORMATION | USER DEFINED FLAG |
|---|---|---|---|---|---|---|---|---|
| | NAME | FIRST ID | SECOND ID (OPTIONAL) | TIME DIFFERENCE INFORMATION | SUMMER TIME INFORMATION (OPTIONAL) | RADIO STATION POSITION INFORMATION (OPTIONAL) | | |
| 1 | Narita_ International_Airport | ac:9e:44:c2:b6:a1 | Narita_ Airport_1_AP | 9 | NO, 0 | 35.770435, 140.384762 | 1222 | 0 |
| 2 | Heathrow_ International_Airport | ac:9e:41:c2:b6:a1 | Heathrow_ Airport_1_AP | 0 | Yes, +1 | 51.470599, -0.463593 | 1222 | 0 |
| • | • | • | • | • | • | • | • | • |
| • | • | • | • | • | • | • | • | • |
| 501 | Ex_MyHome | a1:9e:41:c2:b6:a1 | Yamada_AP | 2 | NO, 0 | | 3600 | 1 |
| • | • | • | • | • | • | • | • | • |
| N | • | • | • | • | • | • | • | • |

FIG. 3

42

| REGION | REGION INFORMATION | TIME DIFFERENCE INFORMATION |
|---|---|---|
| a | (N39,E124), (N31,E146) | +9 |
| b | (N49,E108), (N21,E124) | +8 |
| c | (N21,E93), (N6,E108) | +7 |
| d | ... | ... |
| ... | ... | ... |

FIG. 4

ELECTRONIC TIMEPIECE AND CONTROL METHOD OF ELECTRONIC TIMEPIECE

The present application is based on, and claims priority from, JP Application Serial Number 2019-031332, filed Feb. 25, 2019, the disclosure of which is hereby incorporated by reference herein in its entirety.

BACKGROUND

1. Technical Field

The present disclosure relates to an electronic timepiece and control method of electronic timepiece.

2. Related Art

JP-A-11-136755 discloses a mobile telephone terminal apparatus configured to automatically correct time, to time at destination, by extracting an identification number of abase station from a notification signal of the base station, and reading time difference information corresponding to the identification number, from a time difference table storing the information.

However, information regarding a radio station such as the base station may be changed, and in this case, the time difference table described in JP-A-11-136755 needs to be updated with latest information. When the time difference table is updated, a record that configures the time difference table needs to be acquired from an outside.

SUMMARY

A first aspect is an electronic timepiece that includes a communication unit configured to receive identification information for identifying a radio station from the radio station, a storage unit configured to store a database having, as a record, the identification information and time difference information indicating a time difference associated with the identification information, a timekeeping unit in which a set time difference being a time difference with respect to a reference time is set, a first time difference correction unit configured to correct the set time difference to the time difference information associated with the identification information received by the communication unit, an operation unit configured to accept user operation, a second time difference correction unit configured to correct the set time difference in accordance with the operation, and an update processing unit configured to change the time difference information associated with the identification information received by the communication unit to the set time difference corrected by the second time difference correction unit, to update the database.

A second aspect is an electronic timepiece that includes a communication unit configured to receive identification information for identifying a radio station from the radio station, a storage unit configured to store a database having, as a record, the identification information and time difference information indicating a time difference associated with the identification information, a timekeeping unit in which a set time difference being a time difference with respect to a reference time is set, a first time difference correction unit configured to correct the set time difference to the time difference information associated with the identification information received by the communication unit, a positioning unit configured to use satellite signals received from a plurality of artificial satellites to calculate position information, a second time difference correction unit configured to correct the set time difference to a time difference identified from the position information, and an update processing unit configured to change the time difference information associated with the identification information received by the communication unit to the set time difference corrected by the second time difference correction unit, to update the database.

A third aspect is that, in the first or second aspect, when the identification information received by the communication unit is duplicate in the database, the first time difference correction unit identifies one of the records having the duplicate identification information, one number of the record based on predetermined priority.

A fourth aspect is that, in the third aspect, the database has information indicating, as the priority, an order in which each of the plurality of records is updated.

A fifth aspect is that, in the third aspect, the database has information indicating whether each of the plurality of records is updated by manual setting by the user or not, as the priority.

A sixth aspect is that, in any one of the first to fifth aspects, the communication unit establishes a communication link with the radio station, and the update processing unit acquires update information for updating the database via the communication link with the radio station.

A seventh aspect is that, in any one of the first to sixth aspects, the communication unit establishes a communication link with a radio terminal, and the database is edited by the radio terminal via the communication link with the radio terminal.

An eighth aspect, in any one of the first to seventh aspects, further includes a source display unit for displaying a source type used to correct the set time difference.

A ninth aspect is that, in any one of the first to eighth aspects, the database has radio station position information associated with the identification information, and indicating a position of the radio station, the storage unit stores a time zone table having time difference information for each of a plurality of regions, and the first time difference correction unit, based on the radio station position information associated with the identification information received by the communication unit, identifies the time difference information from the time zone table, and corrects the set time difference to the time difference information identified from the time zone table.

BRIEF DESCRIPTION OF THE DRAWINGS

FIG. 3 is a table illustrating a database in the electronic timepiece according to the exemplary embodiment.

FIG. 4 is a table illustrating a TZ table in the electronic timepiece according to the exemplary embodiment.

DESCRIPTION OF EXEMPLARY EMBODIMENTS

Figure 1:
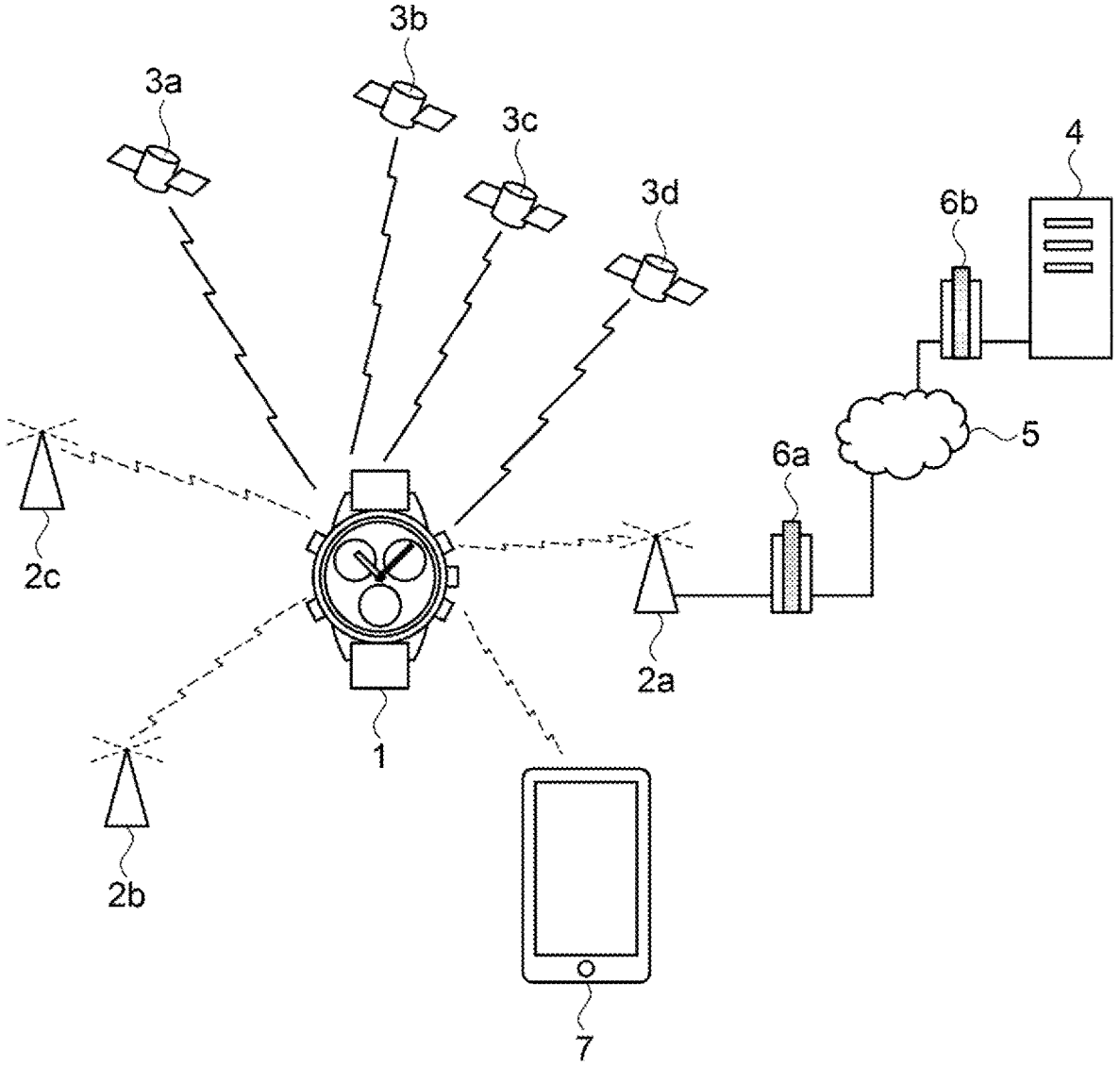
FIG. 1 is a schematic diagram illustrating an environment in which an electronic timepiece according to an exemplary embodiment is used.

An electronic timepiece according to an exemplary embodiment of the present disclosure will be described below with reference to the accompanying drawings. In the drawings, identical or similar elements are labeled with identical or similar symbols, respectively, and redundant descriptions thereof will be omitted. The exemplary embodiment described below illustrates an electronic timepiece for embodying a technical concept of the present disclosure. The technical concept of the present disclosure does not limit materials, structures, configurations, processes, storage information, and the like of the electronic timepiece to those described below. All of the configurations described in the exemplary embodiment are not necessarily essential constituent requirements of the present disclosure.

Electronic Timepiece

As illustrated in FIG. 1, an electronic timepiece 1 according to the present exemplary embodiment receives a radio station signal transmitted from each of a plurality of radio stations 2*a*, 2*b*, and 2*c*. The electronic timepiece 1 is, for example, a watch worn on a wrist of a user. The radio station signal includes identification information identifying the radio stations 2*a* to 2*c* that are transmission sources. In other words, the identification information is information specific to each of the plurality of radio stations 2*a* to 2*c*. Each of the plurality of radio stations 2*a* to 2*c* is an access point compliant with near field communication standards. As near field communication standards, for example, Wi-Fi (registered trademark), Bluetooth (registered trademark), Zigbee (registered trademark), Wi-SUN (registered trademark), and the like, can be adopted. That is, in the present exemplary embodiment, a "near field" means an inside of a range of, for example, some kilometers. In an example illustrated in FIG. 1, the number of radio stations 2*a* to 2*c* is three, but is not particularly limited. Hereinafter, any of the radio stations 2*a* to 2*c* is simply referred to as a "radio station 2".

The electronic timepiece 1 receives a satellite signal transmitted from each of a plurality of artificial satellites 3*a*, 3*b*, 3*c*, and 3*d*. The electronic timepiece 1 uses the satellite signals received from the plurality of artificial satellites 3*a* to 3*d* to calculate position information indicating a position of the electronic timepiece 1 on the Earth. Each of the plurality of artificial satellites 3*a* to 3*d* is a navigation satellite in various navigation satellite systems (NSS), such as, for example, a Global Positioning System (GPS). That is, the number of artificial satellites 3*a* to 3*d* is four or more. Hereinafter, the plurality of artificial satellites 3*a* to 3*d* are collectively referred to as "artificial satellites 3".

Figure 2:
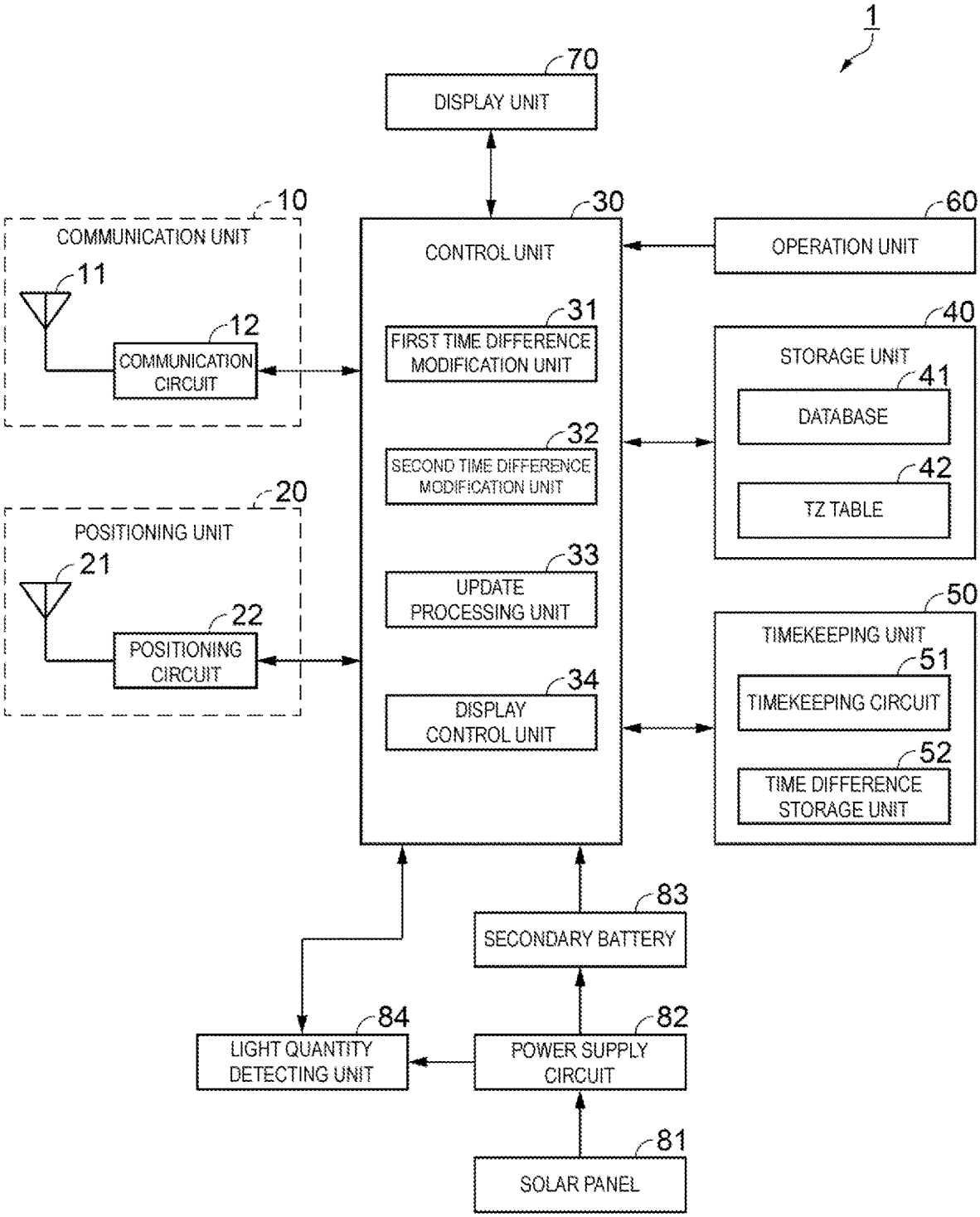
FIG. 2 is a block diagram illustrating a configuration of the electronic timepiece according to the exemplary embodiment.

For example, as illustrated in FIG. 2, the electronic timepiece 1 includes a communication unit 10, a positioning unit 20, a control unit 30, a storage unit 40, a timekeeping unit 50, an operation unit 60 that accepts user operation, and a display unit 70 that displays information to the user. The electronic timepiece 1 further includes a solar panel 81, a power supply circuit 82, a secondary battery 83, and a light quantity detecting unit 84. The communication unit 10 includes a communication antenna 11 and a communication circuit 12. The communication antenna 11 receives a radio station signal transmitted from the radio station 2. The communication circuit 12 acquires identification information for identifying the radio station 2 by demodulating the radio station signal received by the communication antenna 11. Additionally, the communication circuit 12 may cause the communication antenna 11 to transmit a radio signal, by modulating a signal inputted from the control unit 30. Accordingly, the communication unit 10 can communicate with the radio station 2.

The positioning unit 20 includes a positioning antenna 21 and a positioning circuit 22. The positioning antenna 21 receives satellite signals transmitted from the artificial satellites 3. The positioning circuit 22 uses the satellite signals received by the positioning antenna 21 to calculate the position information indicating the position of electronic timepiece 1 on the Earth. The position information is information defined by, for example, longitude and latitude. The positioning circuit 22 calculates the position information in accordance with control by the control unit 30, and outputs the position information to the control unit 30.

The storage unit 40 stores a database 41 and a time zone (TZ) table 42. The storage unit 40 is a storage device including, for example, a semiconductor memory. The storage unit 40 is a computer readable storage medium that stores programs indicative of a series of processes and various data necessary for operation of the electronic timepiece 1. The storage unit 40 is not limited to a non-volatile auxiliary storage device, and may include a main storage device such as a register or a cache memory, built in a processing circuit such as a Central Processing Unit (CPU).

As illustrated in FIG. 3, the database 41 has radio station information including identification information of the radio station 2, and time zone information including information associated with a time zone of the radio station 2, as a record for each of the radio stations 2. The radio station information includes, for example, a name of the radio station 2, a first identifier (ID) that is a Media Access Control (MAC) address of the radio station 2, a second ID that is a Service Set IDentifier (SSID) of the radio station 2. In the present exemplary embodiment, the identification information of the radio station 2 will be described by way of example as the first ID. The name of the radio station 2 is information for facilitating management by human. The second ID is optional information, and is information such as the SSID acquired by scanning a radio station signal receivable by the communication unit 10.

The time zone information in the database 41 includes, for example, time difference information indicating a time difference with respect to Coordinated Universal Time (UTC), summer time information indicating whether Daylight-Saving Time (DST) is enforced or not, radio station position information indicating a position of the radio station 2 identified by the identification information, and the like. Each time zone information is associated with each identification information of the radio station 2. The time difference information indicates a time difference at a place where the radio station 2 is installed. The summer time information is optional information and indicates whether DST is enforced or not, and an offset time when DST is enforced. The radio station position information is optional information, for example, indicating longitude and latitude of the radio station 2.

As illustrated in FIG. 4, the TZ table 42 is a table having region information and time difference information for each of a plurality of regions, for example. The region information indicates, for example, latitude and longitude of two points on a diagonal defining a rectangle having two sides along a latitude line and two sides along a longitude line. The time difference information indicates a time difference with respect to UTC, associated with each region. It is understood from FIG. 4 that, for example, a region a is a rectangular region defined by a spot as a north west end at north latitude 39 degrees, east longitude 124 degrees, and a spot as a south east end at north latitude 31 degrees, and east longitude 146 degree, and a time difference therein is +9 hours with respect to UTC. In the TZ table 42, a DST period and an offset time in the DST period may be recorded, as information associated with each region.

The timekeeping unit 50, for example, as illustrated in FIG. 2, includes a timekeeping circuit 51 and a time difference storage unit 52. The timekeeping circuit 51 clocks a reference time being UTC and a local standard time with a time difference with respect to the reference time, for example. The timekeeping circuit 51 is constituted of, for example, an integrated circuit (IC). The timekeeping circuit 51 generates a reference signal by, for example, dividing an oscillation signal generated using a crystal oscillator. The timekeeping circuit 51 clocks the reference time and the local standard time based on the reference signal. The time difference storage unit 52 is a storage device that stores a time difference in the local standard time, as a set time difference. In other words, the set time difference, which is the time difference with respect to the reference time is set to the timekeeping unit 50 by the time difference storage unit 52. The time difference storage unit 52 may share a hardware resource with the storage unit 40.

As illustrated in FIG. 2, for example, the control unit 30 is logically expressible as a block having four logical operation circuits, that is, a first time difference correction unit 31, a second time difference correction unit 32, an update processing unit 33, and a display control unit 34. A hardware resource constituting the control unit 30 is a processing circuit such as a CPU, a microprocessor (MPU), or the like. The control unit 30 may be constituted by one or more processing circuits. The control unit 30 configures a computer system that processes operations necessary for operation of the electronic timepiece 1. The control unit 30 executes an installed program to perform each function described in the present exemplary embodiment. The control unit 30 may share a hardware resource with the timekeeping unit 50.

The first time difference correction unit 31 corrects the set time difference set to the timekeeping unit 50 to time difference information associated with identification information received by the communication unit 10. In other words, the first time difference correction unit 31 searches the database 41 for a first ID matching the identification information acquired from the communication unit 10. The first time difference correction unit 31 identifies time difference information from time zone information associated with a found first ID. The first time difference correction unit 31 performs time difference correction or time zone correction, by changing set time difference stored in the time difference storage unit 52 to the identified time difference information. As described above, the first time difference correction unit 31 performs the time zone correction, using near field radio by the communication unit 10 as a source (information source).

When the first ID matching the identification information received by the communication unit 10 is duplicate in the database 41, the first time difference correction unit 31 identifies one record based on predetermined priority, from a plurality of records having the duplicate first ID. The priority may be, for example, information indicating an order in which a record is updated, or information indicating whether or not update is performed by manual setting by the user.

The second time difference correction unit 32 corrects the set time difference set to the timekeeping unit 50, in accordance with user operation on the operation unit 60, for example. In other words, the second time difference correction unit 32 is inputted with time difference information from the operation unit 60 in accordance with the user operation. The second time difference correction unit 32 performs the time zone correction, by changing the set time difference stored in the time difference storage unit 52, to the time difference information inputted from the operation unit 60. As described above, the second time difference correction unit 32 performs the time zone correction using user input by the operation unit 60 as a source.

Alternatively, the second time difference correction unit 32 may correct the set time difference set to the timekeeping unit 50, based on position information calculated by the positioning unit 20. That is, the second time difference correction unit 32 is inputted from the positioning unit 20 with position information calculated using signals received from the artificial satellites 3. The second time difference correction unit 32 searches the TZ table 42 for region information including the position information inputted from the positioning unit 20, and identifies time difference information associated with found region information. The second time difference correction unit 32 performs the time zone correction, by changing the set time difference stored in the time difference storage unit 52, to the identified time difference information. In this way, the second time difference correction unit 32 performs the time zone correction using satellite positioning by the positioning unit 20 as a source.

The update processing unit 33 updates a record in the database 41 using the set time difference corrected by the second time difference correction unit 32. In other words, the update processing unit 33 searches the database 41 for a first ID that matches the identification information received by the communication unit 10. The update processing unit 33 updates the database 41, by changing time difference information associated with a found first ID to the set time difference corrected by the second time difference correction unit 32. In this manner, the update processing unit 33 does not need that a record to update the database 41 is downloaded or written from an outside, and can update the database 41 to a current state.

In a small device such as an electronic timepiece, it is difficult to provide power for connecting directly and constantly to a network via an unspecified large number of radio stations, to provide a means for acquiring connection information such as individual IDs and passwords for connecting to the unspecified large number radio stations, and to provide storage capacity for storing all of the connection information. Thus, the database 41 may be updated to a current state, without acquiring records via the unspecified large number of radio stations.

In addition, the update processing unit 33 may acquire update information from an information providing server 4 via the radio station 2 that is predetermined. The update information may be information to change a record in the database 41, or may be a record to be added to the database 41.

The display control unit 34 controls the display unit 70 to display time or display a source of time zone correction. For example, the display control unit 34 causes the display unit 70 to display a local standard time that is clocked by the timekeeping unit 50. Further, the display control unit 34 causes the display unit 70 to display a source of recently performed time zone correction.

Figure 5:
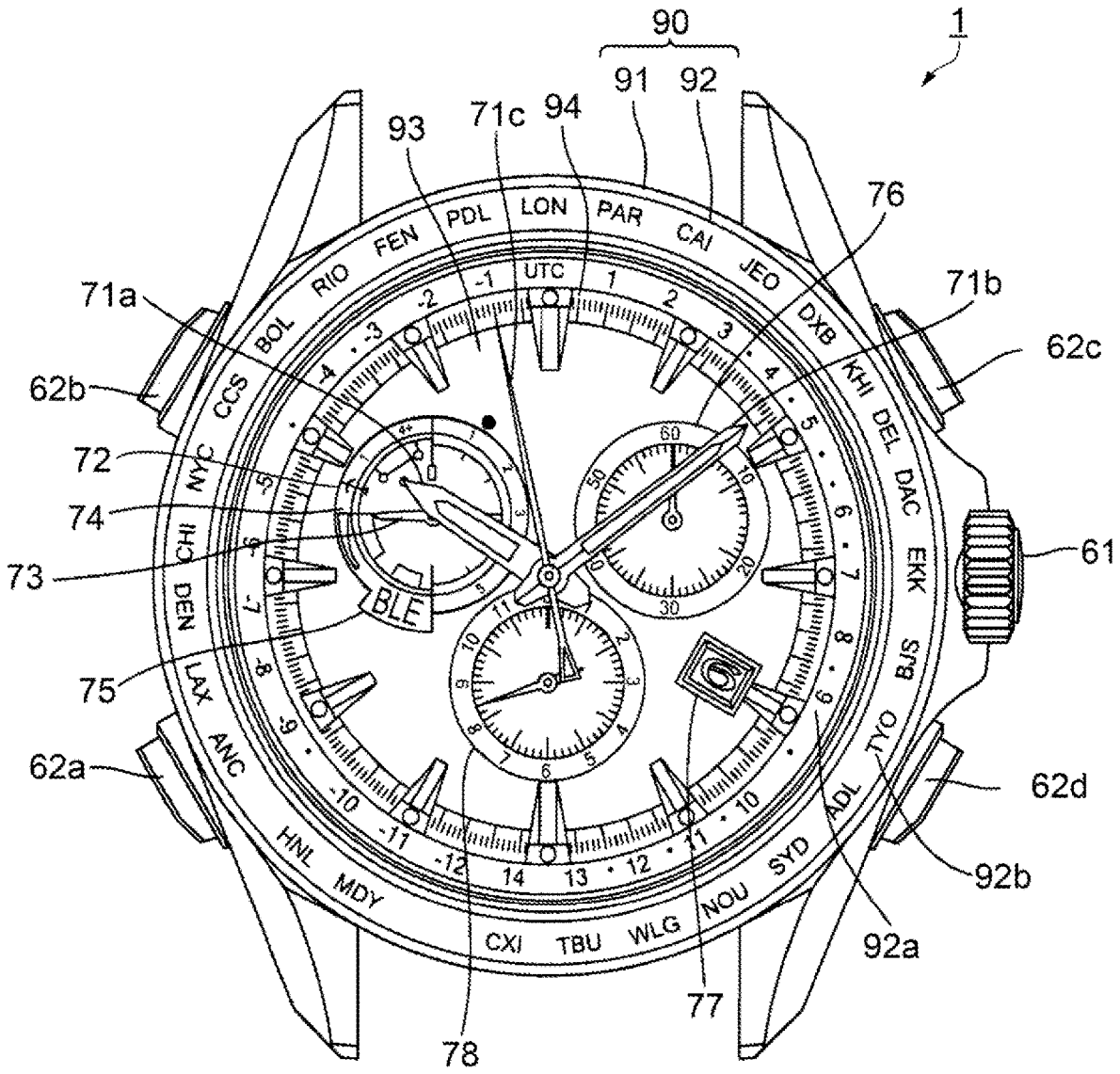
FIG. 5 is a diagram illustrating visual appearance of the electronic timepiece according to the exemplary embodiment.

For example, as illustrated in FIG. 5, the electronic timepiece 1 includes an outer packaging case 90 that includes a cylindrical case 91 and an annular bezel 92 fitted to the case 91. The outer packaging case 90 further includes a case back (not illustrated) that covers an opening on a back side of the case 91, and a cover glass (not illustrated) that covers an opening on a front side of the case 91 together with the bezel 92.

The electronic timepiece 1 further includes a crown 61, a first button 62*a*, a second button 62*b*, a third button 62*c*, and a fourth button 62*d*, each provided on aside surface of the case 91. The bezel 92 has a time difference display unit 92*a* and a time zone display unit 92*b* that are concentric. A surface of the time difference display unit 92*a* is marked with letters "UTC" that indicate that a time difference with respect to UTC is zero, and a number indicating a time difference with respect to UTC. A surface of the time zone display unit 92*b* is marked with a three-letter code indicating a representative city name of each time zone.

The electronic timepiece 1 includes, a schematically disk-shaped dial 93, an annular dial ring 94 disposed around a periphery of the dial 93, an hour hand 71*a*, a minute hand 71*b*, and a seconds hand 71*c* each rotating about a central axis of the dial 93, inside the outer packaging case 90. The electronic timepiece 1 displays time by pointing scales marked on the dial ring 94 with the hour hand 71*a*, the minute hand 71*b*, and the seconds hand 71*c*. The dial 93 is formed from a plastic material such as polycarbonate, for example, that transmits light to the solar panel 81.

The dial 93 includes, for example, an indicator unit 72 indicating various information, a chronograph unit 76 displaying minute of a stop-watch, a small clock 78, and a date display unit 77. The indicator unit 72 includes, for example, a pointer 73, an annular symbol display unit 74 having a plurality of symbols pointed by the pointer 73, and a source display unit 75. A surface of the symbol display unit 74 is marked with, for example, "1" meaning that one satellite signal is received for time correction, a symbol of "4+" meaning that four or more satellite signals are received for satellite positioning, a symbol of an airplane meaning an airplane mode that invalidates reception of radio waves, an arcuate symbol indicating an amount of battery remaining with a width, and the like. In an example illustrated in FIG. 5, a right half of the symbol display unit 74 is marked with scales for displaying hour of the stop-watch.

The source display unit 75 displays a source type used for recently performed time zone correction. When set time difference of the timekeeping unit 50 is corrected by the first time difference correction unit 31 or the second time difference correction unit 32, the source display unit 75 displays a symbol that means a source of time zone correction, that is, near field radio, user input, or satellite positioning. In the example illustrated in FIG. 5, a symbol "BLE" is displayed on the source display unit 75. In this case, the source display unit 75 means that the communication unit 10 receives a beacon signal compliant with Bluetooth Low Energy (BLE) being near field communication standards, as a radio station signal, and the first time difference correction unit 31 performs the time zone correction using the near field radio as a source. The source display unit 75 rotates a plate marked with a symbol, for example, meaning a source type, and displays the symbol via a window opened in the indicator unit 72. The source display unit 75 may display a source type of time zone correction, by pointing a symbol marked on the symbol display unit 74, meaning the source type, with the pointer 73. Furthermore, various display methods such as an electronic paper may be employed, as the source display unit 75.

The chronograph unit 76 displays minute of the stop-watch by pointing circular scales with a chronograph hand. Note that, for example, display of ⅕ seconds of the stop-watch is performed by the seconds hand 71*c*. The small clock 78 performs dual time display, for example, by displaying a second time different from a first time pointed by the hour hand 71*a*, the minute 71*b*, and the seconds hand 71*c*. The date display unit 77 selectively displays a current date, by rotating a calendar wheel marked with dates, for example, via a calendar window opened in the dial 93.

The operation unit 60 illustrated in FIG. 2 is configured from operating members such as, for example, the crown 61, the first button 62*a*, the second button 62*b*, the third button 62*c*, and the fourth button 62*d* illustrated in FIG. 5. Each of the operating members of the operation unit 60 is exposed to an outer side of the outer packaging case 90 on the side surface of the case 91. Each of the operating members of the operation unit 60 accepts user operation, and outputs a signal corresponding to the user operation to the control unit 30.

The display unit 70 illustrated in FIG. 2 includes, for example, a time display unit configured with the hour hand 71*a*, the minute hand 71*b*, the seconds hand 71*c*, and the dial 93 or the dial ring 94, and information display members such as the indicator unit 72, the chronograph unit 76, the small clock 78, and the date display unit 77, illustrated in FIG. 5. Furthermore, the display unit 70 includes, for example, a plurality of stepper motors, a plurality of train wheels, a drive circuit, and the like for driving the hour hand 71*a*, the minute hand 71*b*, the seconds hand 71*c*, the pointer 73, a hand of the small clock 78, a calendar wheel of the date display unit 77, and the like.

The solar panel 81 is a charging power source that charges the secondary battery 83 by supplying power to the secondary battery 83. The solar panel 81 is constituted of a plurality of solar cells coupled in series with one another, for example. The power supply circuit 82 converts power outputted by the solar panel 81 and supplies the power to the secondary battery 83. The secondary battery 83 is a storage battery such as, for example, a rechargeable button battery. The secondary battery 83 supplies power to each circuit in the electronic timepiece 1, and drives each circuit. The light quantity detecting unit 84 detects, for example, the power outputted from the solar panel 81 as light quantity. The light quantity detecting unit 84 may be a sensor such as a light sensor that senses light quantity, or an ultraviolet light sensor. Since the electronic timepiece 1 can update the database 41 with low power consumption, and includes the solar panel 81, secondary battery 83, and the like, regular maintenance, such as charging from an outside and battery replacement, can be omitted.

Operation of Electronic Timepiece

Referring to flowcharts in FIG. 6 to FIG. 10, an example of a time zone correction method that includes a database update method is described, as operation of the electronic timepiece 1 according to the present exemplary embodiment.

Figure 6:
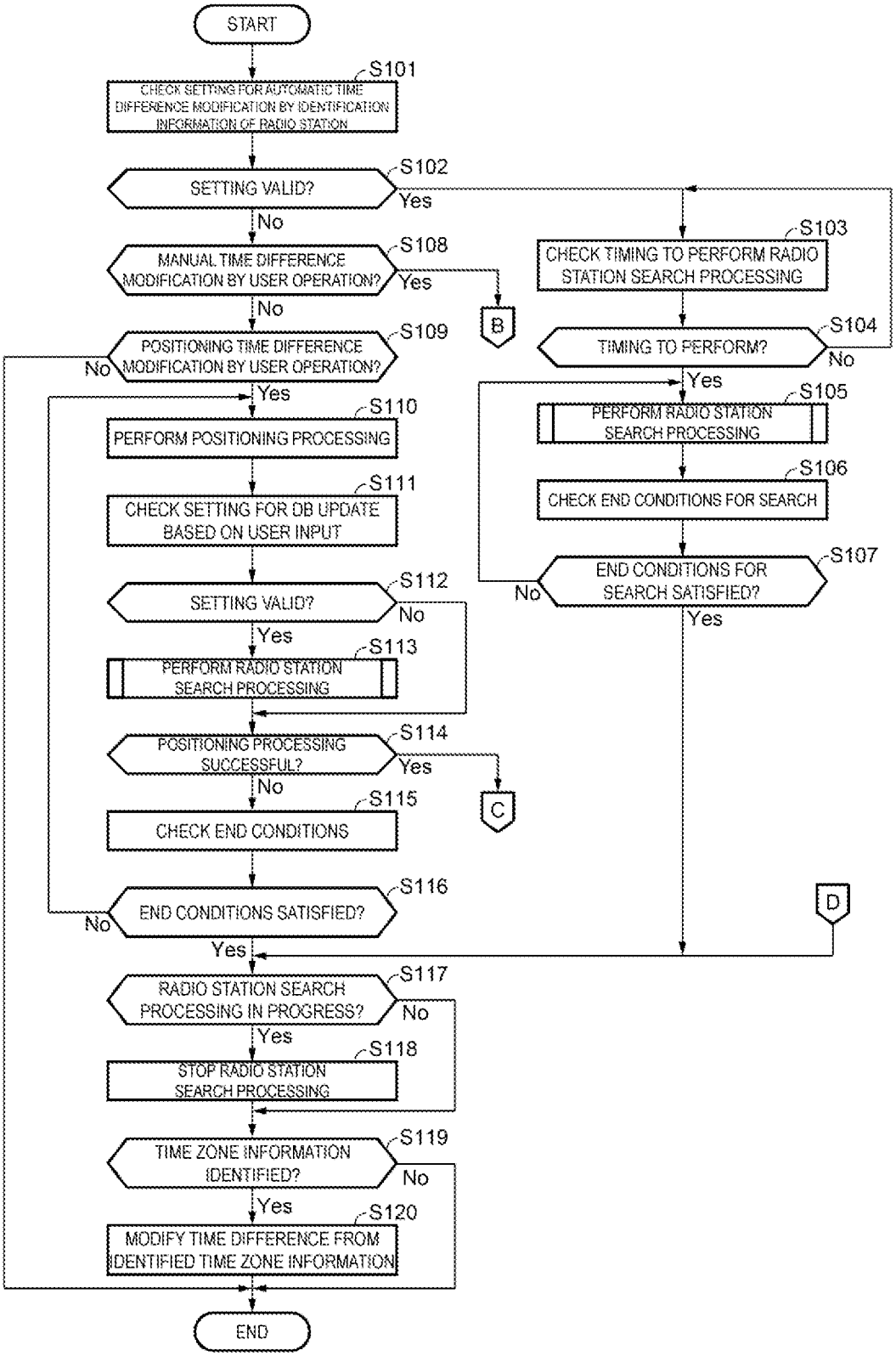
FIG. 6 is a flowchart illustrating a method for correcting a time zone.

As illustrated in FIG. 6, in step S101, the first time difference correction unit 31 first checks setting for automatic time difference correction by identification information of the radio station 2. That is, the first time difference correction unit 31 checks whether automatic performance of time zone correction using radio station information in the database 41 is set or not.

In step S102, the first time difference correction unit 31 determines whether the setting checked in step S101 is valid or not. When the setting is valid, the first time difference correction unit 31 proceeds the processing to step S103, and when the setting is invalid, proceeds the processing to step S108.

In step S103, the first time difference correction unit 31 checks a timing to perform radio station search processing. In step S104, the first time difference correction unit 31 determines whether a current time is the timing to perform checked in step S103 or not. When the current time is the timing to perform, the first time difference correction unit 31 proceeds the processing to step S105, and when the current time is not the timing to perform, returns the processing to step S103.

In step S105, the first time difference correction unit 31 performs the radio station search processing. The first time difference correction unit 31 performs a series of processes illustrated in the flowchart in FIG. 7 as the radio station search processing in step S105.

Figure 7:
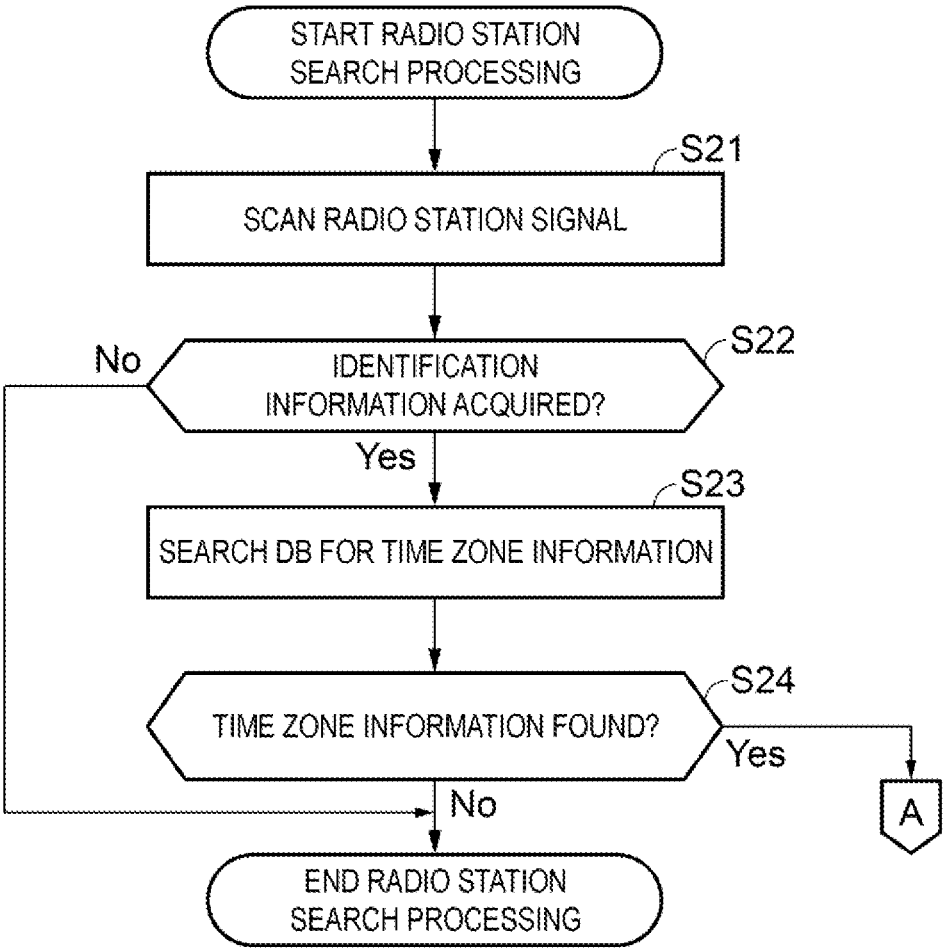
FIG. 7 is a flowchart illustrating radio station search processing.

As illustrated in FIG. 7, in step S21, the first time difference correction unit 31 controls the communication circuit 12 of the communication unit 10 to scan a radio station signal received by the communication antenna 11.

In step S22, the first time difference correction unit 31 determines whether one or more radio station signals are found by the scan in step S21, and identification information can be acquired from the communication unit 10 or not. The first time difference correction unit 31, when the identification information is acquired, proceeds the processing to step S23, and when the identification information is not acquired, terminates the radio station search processing, and proceeds the processing to step S106 in FIG. 6.

In step S23, the first time difference correction unit 31 refers the database (DB) 41, and searches for time zone information associated with the identification information acquired in step S22, that is, identification information received in step S21. Specifically, the first time difference correction unit 31 searches the database 41 for a record having a first ID that matches the identification information received in step S21, and selects time zone information in a found record as a candidate.

In step S24, the first time difference correction unit 31 determines whether the time zone information associated with the identification information received in step S21 is found in step S23 or not. The first time difference correction unit 31, when the time zone information is found, proceeds the processing to step S301 in FIG. 8, and when the time zone information is not found, terminates the radio station search processing, and proceeds the processing to step S106 in FIG. 6.

In step S106, the first time difference correction unit 31 checks end conditions for the radio station search processing. The end conditions include, for example, that a time elapsed since start of the radio station search processing reaches a timeout time, that the number of radio stations 2 transmitting found radio station signals reaches a threshold value, and the like. In addition, the end conditions may be determined in accordance with use applications or power consumption.

In step S107, the first time difference correction unit 31 determines whether the end conditions for the radio station search processing checked in step S106 are satisfied not. The first time difference correction unit 31, when the end conditions are satisfied, proceeds the processing to step S117, and when the end conditions are not satisfied, returns the processing to step S105, that is, step S21.

Figure 8:
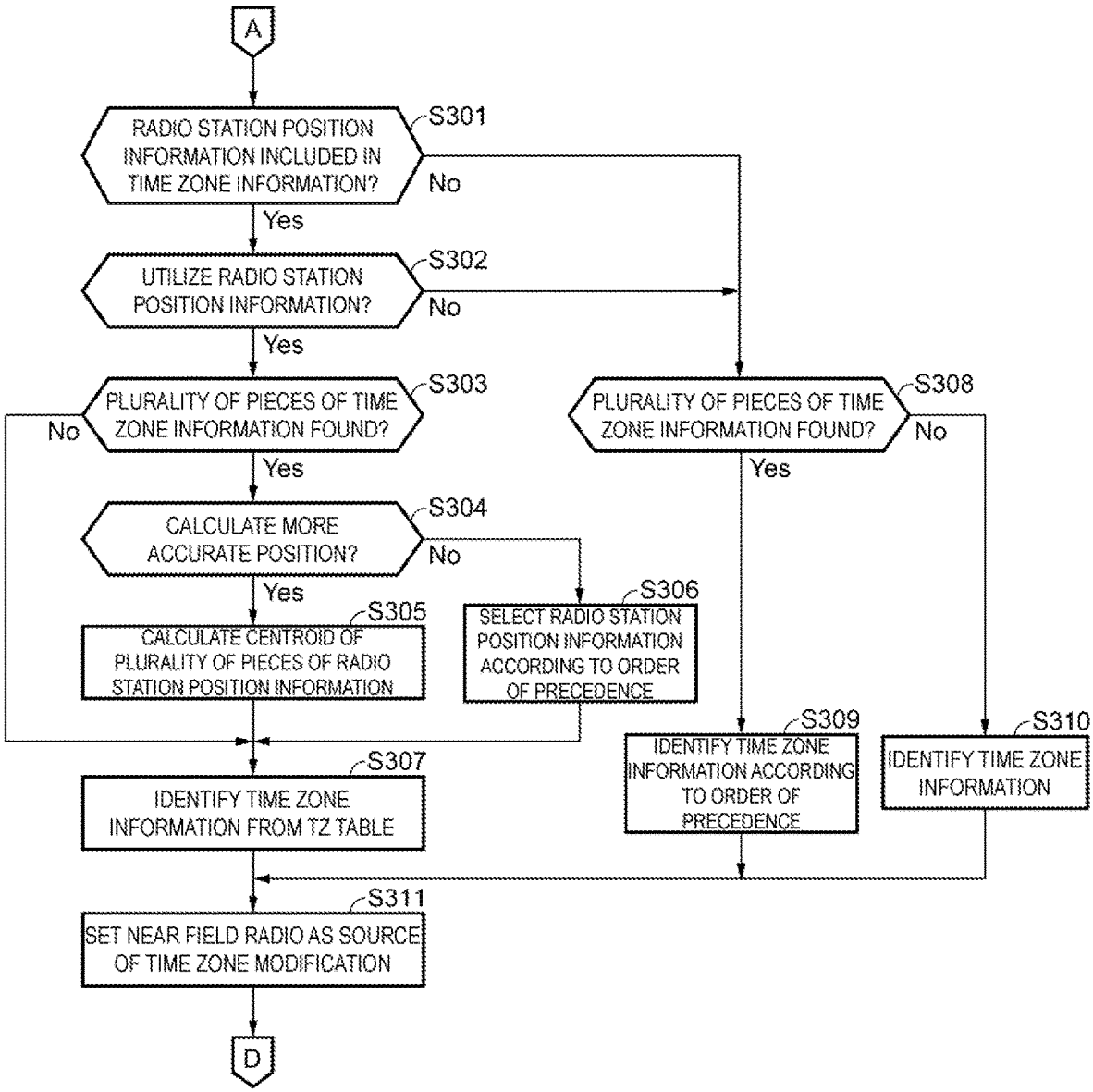
FIG. 8 is a flowchart illustrating a method for identifying one piece of time zone information from time zone information found in the radio station search processing.

As illustrated in FIG. 8, in step S301, the first time difference correction unit 31 determines whether radio station position information is included in the found time zone information or not. The first time difference correction unit 31, when radio station position information is included, proceeds the processing to step S302, and when radio station position information is not included, proceeds the processing to step S308.

In step S302, the first time difference correction unit 31 determines whether to utilize the radio station position information included in the found time zone information for identification of time zone information or not. The first time difference correction unit 31, when the radio station position information is utilized, proceeds the processing to step S303, and when the radio station position information is not utilized, proceeds the processing to step S308.

In step S303, the first time difference correction unit 31 determines whether a plurality of pieces of time zone information are found in step S23 or not. When a plurality of pieces of time zone information are found, the first time difference correction unit 31 proceeds the processing to step S304. When a plurality of pieces of time zone information are not found, that is, when only one piece of time zone information is selected, the first time difference correction unit 31 selects radio station position information included in the time zone information, and proceeds the processing to step S307.

In step S304, the first time difference correction unit 31 determines whether to calculate a more accurate current position of the electronic timepiece 1, from a plurality of pieces of radio station position information included in the plurality of pieces of time zone information or not. In other words, the first time difference correction unit 31 determines whether estimation of a current position of the electronic timepiece 1 from a plurality of pieces of radio station position information is set or not. The first time difference correction unit 31, when a current position is calculated, proceeds the processing to step S305, and when a current position is not calculated, proceeds the processing to step S306.

In step S305, the first time difference correction unit 31, from a plurality of pieces of radio station position information, and electric field intensity of a radio station signal corresponding to each piece of the radio station position information, calculates a centroid of the plurality of pieces of radio station position information, to estimate information of a current position of the electronic timepiece 1. The first time difference correction unit 31 selects the calculated position information, and proceeds the processing to step S307.

In step S306, the first time difference correction unit 31 identifies radio station position information based on predetermined priority. For example, the database 41 has update time information, which is information indicating an order in which a record is updated, and a user defined flag for each record. At this time, the first time difference correction unit 31 may identify one piece of radio station position information that is recently updated, based on the update time information. Alternatively, when the database 41 has information indicating that a record is updated by manual setting by the user as the user defined flag, the first time difference correction unit 31 may identify one piece of radio station position information for which the user defined flag is on. In this manner, the first time difference correction unit 31 selects the radio station position information according to an order of precedence defined by the priority, and proceeds the processing to step S307.

In step S307, the first time difference correction unit 31 refers the TZ table 42 to identify time difference information corresponding to the selected position information. That is, the first time difference correction unit 31 searches the TZ table 42 for region information corresponding to the selected radio station position information or the estimated current position information of the electronic timepiece 1, and identifies time difference information associated with found region information as time zone information. As described above, the first time difference correction unit 31 identifies the one piece of time zone information from the TZ table 42, based on the radio station position information associated with the identification information received by the communication unit 10, and then proceeds the processing to step S311.

In step S308, the first time difference correction unit 31 determines whether a plurality of pieces of time zone information are found in step S23 or not. The first time difference correction unit 31, when a plurality of pieces of time zone information are found, proceeds the processing to step S309, and when a plurality of pieces of time zone information are not found, that is, when only one piece of time zone information is selected, proceeds the processing to step S310.

In step S309, the first time difference correction unit 31 identifies time zone information based on predetermined priority. For example, the first time difference correction unit 31 may identify one piece of time zone information updated recently, based on update time information for a record recorded in the database 41. Alternatively, the first time difference correction unit 31 may identify one piece of time zone information for which a user defined flag indicating that a record is updated by manual setting by the user is on. In this manner, the first time difference correction unit selects the time zone information according to an order of precedence defined by the priority, and proceeds the processing to step S311.

In step S310, the first time difference correction unit 31 identifies the selected one piece of time zone information and proceeds the processing to step S311.

In step S311, the first time difference correction unit 31 sets near field radio as a source of time zone correction that means on what information recent time zone correction is based to be performed. The first time difference correction unit 31, for example, stores information indicating the near field radio as the source of the time zone correction in the storage unit 40. The source of the time zone correction stored in the storage unit 40 is displayed by the source display unit 75. The near field radio as the source means that the time zone correction is performed based on a radio station signal received from the radio station 2. The first time difference correction unit 31 sets the source of the time zone correction, and then proceeds the processing to step S117 in FIG. 6.

As illustrated in FIG. 6, when it is determined in step S102 that the setting for automatic time difference correction by identification information of the radio station 2 is invalid, then in step S108, the second time difference correction unit 32 determines whether to perform manual time difference correction by user operation or not. That is, the second time difference correction unit 32, when detecting user operation instructing start of the manual time difference correction from the operation unit 60, determines to perform the manual time difference correction, and proceeds the processing to step S401 in FIG. 9. The second time difference correction unit 32, when not determining to perform the manual time difference correction, proceeds the processing to step S109.

Figure 9:
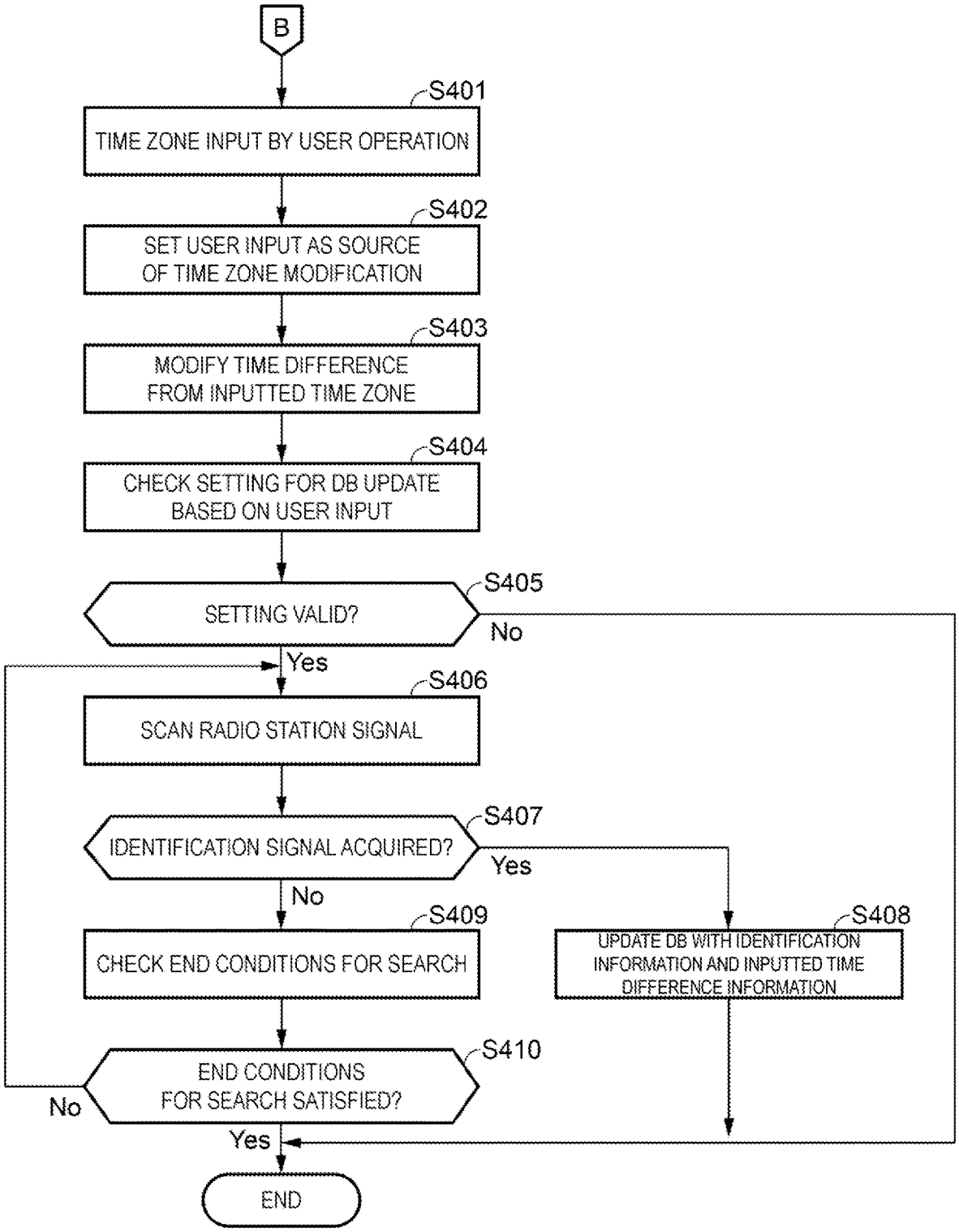
FIG. 9 is a flowchart illustrating a method for manually correcting a time difference.

As illustrated in FIG. 9, in step S401, the second time difference correction unit 32 is inputted with a time zone, that is, time difference information, by user operation on the operation unit 60. The user may, for example, input desired time difference information into the second time difference correction unit 32 by manipulating the crown 61 to point a time zone and a time difference displayed on the bezel 92 with the seconds hand 71*c*.

In step S402, the second time difference correction unit 32 sets user input as a source of time zone correction. The second time difference correction unit 32, for example, stores information indicating the user input as the source of the time zone correction in the storage unit 40. The user input as the source means that the time zone correction is performed based on the user operation on the operation unit 60.

In step S403, the second time difference correction unit 32 performs time difference correction from the time zone inputted in step S401. That is, the second time difference correction unit 32 performs the time zone correction, by changing set time difference stored in the time difference storage unit 52 to the time difference information inputted in step S401.

In step S404, the update processing unit 33 checks setting for database update based on user input. In other words, the update processing unit 33, along with manual time difference correction, checks whether setting for updating a corresponding record in the database 41 is valid or not.

In step S405, the update processing unit 33 determines whether the setting checked in step S404 is valid or not. The update processing unit 33, when the setting is valid, proceeds the processing to step S406, and when the setting is invalid, terminates the processing.

In step S406, the update processing unit 33 starts radio station search processing, and starts receiving a radio station signal. In other words, the update processing unit 33 scans a radio station signal received by the communication antenna 11, by controlling the communication circuit 12 of the communication unit 10.

In step S407, the update processing unit 33 determines whether a radio station signal is found in the scan in step S406, and an identification signal can be acquired from the communication unit 10 or not. The update processing unit 33, when identification information is acquired, proceeds the processing to step S408, and when identification information is not acquired, proceeds the processing to step S409.

In step S408, the update processing unit 33 updates the database 41 using the identification information acquired in step S407, and the time difference information inputted in step S401. In other words, the update processing unit 33 searches the database 41 for a first ID matching the identification information acquired in step S407. The update processing unit 33 updates the database 41 by changing time difference information associated with a found first ID to the time difference inputted by the user. When there is no first ID that matches the identification information, it is sufficient that the update processing unit 33 updates the database 41, by newly creating a record with the identification information acquired in step S407 as a first ID, and recording the time difference inputted by the user as associated time difference information. The update processing unit 33 updates the database 41, and in addition, turns on a corresponding user defined flag, and terminates the processing.

In step S409, the update processing unit 33 checks end conditions for the radio station search processing. The end conditions include, for example, that a time elapsed since start of the radio station search processing reaches a timeout time, that the number of radio stations 2 transmitting found radio station signals reaches a threshold value, and the like.

In step S410, the update processing unit 33 determines whether the end conditions for the radio station search processing checked in step S409 are satisfied or not. The update processing unit 33, when the end conditions are satisfied, terminates the processing, and when the end conditions are not satisfied, returns the processing to step S406.

As illustrated in FIG. 6, when it is not determined that the manual time difference correction is performed in step S108, then in step S109, the second time difference correction unit 32 determines whether to perform positioning time difference correction by user operation or not. In other words, the second time difference correction unit 32, when detecting user operation indicating start of the positioning time difference correction from the operation unit 60, determines to perform the positioning time difference correction, and proceeds the processing to step S110. The second time difference correction unit 32, when not determining to perform the positioning time difference correction, terminates the processing.

In step S110, the second time difference correction unit 32 performs positioning processing. In other words, in accordance with control by the second time difference correction unit 32, the positioning unit 20 receives satellite signals transmitted from the artificial satellites 3, and calculates position information indicating a current position of the electronic timepiece 1 using the satellite signals. The second time difference correction unit 32 acquires the calculated position information from the positioning unit 20.

In step S111, the update processing unit 33 checks setting for database update based on user input. In other words, the update processing unit 33, along with manual time difference correction, checks whether setting for updating a corresponding record in the database 41 is valid or not.

In step S112, the first time difference correction unit 31 determines whether the setting checked in step S111 is valid or not. When the setting is valid, the first time difference correction unit 31 proceeds the processing to step S113, and when the setting is invalid, proceeds the processing to step S114.

In step S113, the first time difference correction unit 31 performs radio station search processing in parallel with the positioning processing in step S110. The first time difference correction unit 31 performs the series of processes illustrated in the flowchart in FIG. 7 as the radio station search processing in step S113. By performing the processes in steps S111 to S113, erroneous time zone correction can be prevented from being made, when erroneous information is recorded in the database 41.

In step S114, the second time difference correction unit 32 determines whether the positioning processing performed in step S110 succeeds or not. When position information is acquired from the positioning unit 20, the second time difference correction unit 32 determines that the positioning processing succeeds, and proceeds the processing to step S51 in FIG. 10. When position information cannot be acquired from the positioning unit 20, the second time difference correction unit 32 determines that the positioning processing fails, and proceeds the processing to step S115.

In step S115, the second time difference correction unit 32 checks end conditions for the positioning processing and the radio station search processing. The end conditions include, for example, that a time elapsed since start of the positioning processing and a time elapsed since start of the radio station search processing each reach a timeout time, and the like.

In step S116, the second time difference correction unit 32 determines whether the end conditions checked in step S115 are satisfied or not. The second time difference correction unit 32, when the end conditions are satisfied, proceeds the processing to step S117, and when the end conditions are not satisfied, returns the processing to step S110.

Figure 10:
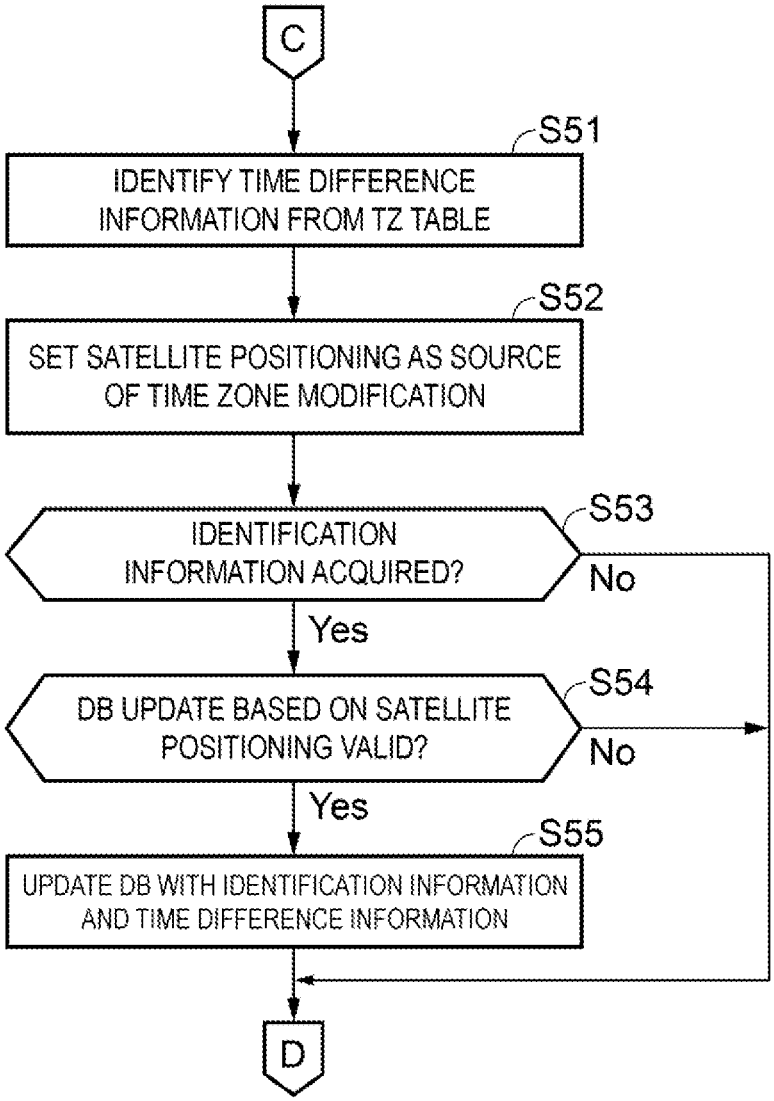
FIG. 10 is a flowchart illustrating processing for time zone correction by satellite positioning.

As illustrated in FIG. 10, in step S51, the second time difference correction unit 32 identifies time difference information from the TZ table 42. In other words, the second time difference correction unit 32 searches the TZ table 42 for region information including the position information acquired from the positioning unit 20, and identifies time difference information associated with region information found as time zone information.

In step S52, the second time difference correction unit 32 sets satellite positioning as a source of time zone correction. The second time difference correction unit 32, for example, stores information indicating the satellite positioning as the source of the time zone correction in the storage unit 40. The satellite positioning as the source means that the time zone correction is performed based on position information calculated by the positioning unit 20.

In step S53, the update processing unit 33 determines whether identification information is acquired in the radio station search processing in step S113 or not. The update processing unit 33, when identification information is acquired, proceeds the processing to step S54, and when identification information is not acquired, proceeds the processing to step S117 in FIG. 6.

In step S54, the update processing unit 33 checks whether database update based on satellite positioning is valid or not. In other words, the update processing unit 33, along with time difference correction by the satellite positioning, checks whether setting for updating a corresponding record in the database 41 is valid or not. When the setting is valid, the update processing unit 33 proceeds the processing to step S55, and when the setting is invalid, proceeds the processing to step S117 in FIG. 6.

In step S55, the update processing unit 33 updates the database 41, using the identification information acquired in the radio station search processing in step S113, and the time difference information identified in step S51. For example, the update processing unit 33 searches the database 41 for a first ID matching the acquired identification information, and updates the database 41 by changing time difference information associated with a found first ID to the identified time difference information. When there is no first ID that matches the identification information, it is sufficient that the update processing unit 33 updates the database 41 by newly creating a record with the identification information acquired as a first ID, and recording the time difference identified as time difference information associated with the first ID. The update processing unit 33 updates the database 41, and proceeds the processing to step S117 in FIG. 6.

As illustrated in FIG. 6, in step S117, the first time difference correction unit 31 determines whether the radio station search processing is being performed or not. When the radio station search processing is being performed, the first time difference correction unit 31 stops processing at step S118, and when the radio station search processing is not being performed, proceeds the processing to step S119.

In step S119, the first time difference correction unit 31 determines whether time zone information is already identified or not. When time zone information is identified, in step S120, the first time difference correction unit 31 performs time difference correction from identified time zone information, and terminates the processing. Specifically, the first time difference correction unit 31 performs the time zone correction, by changing set time difference stored in the time difference storage unit 52 to time difference information for the identified time zone information. On the other hand, when time zone information is not identified, the first time difference correction unit 31 terminates the processing.

Acquisition of Update Information

Figure 11:
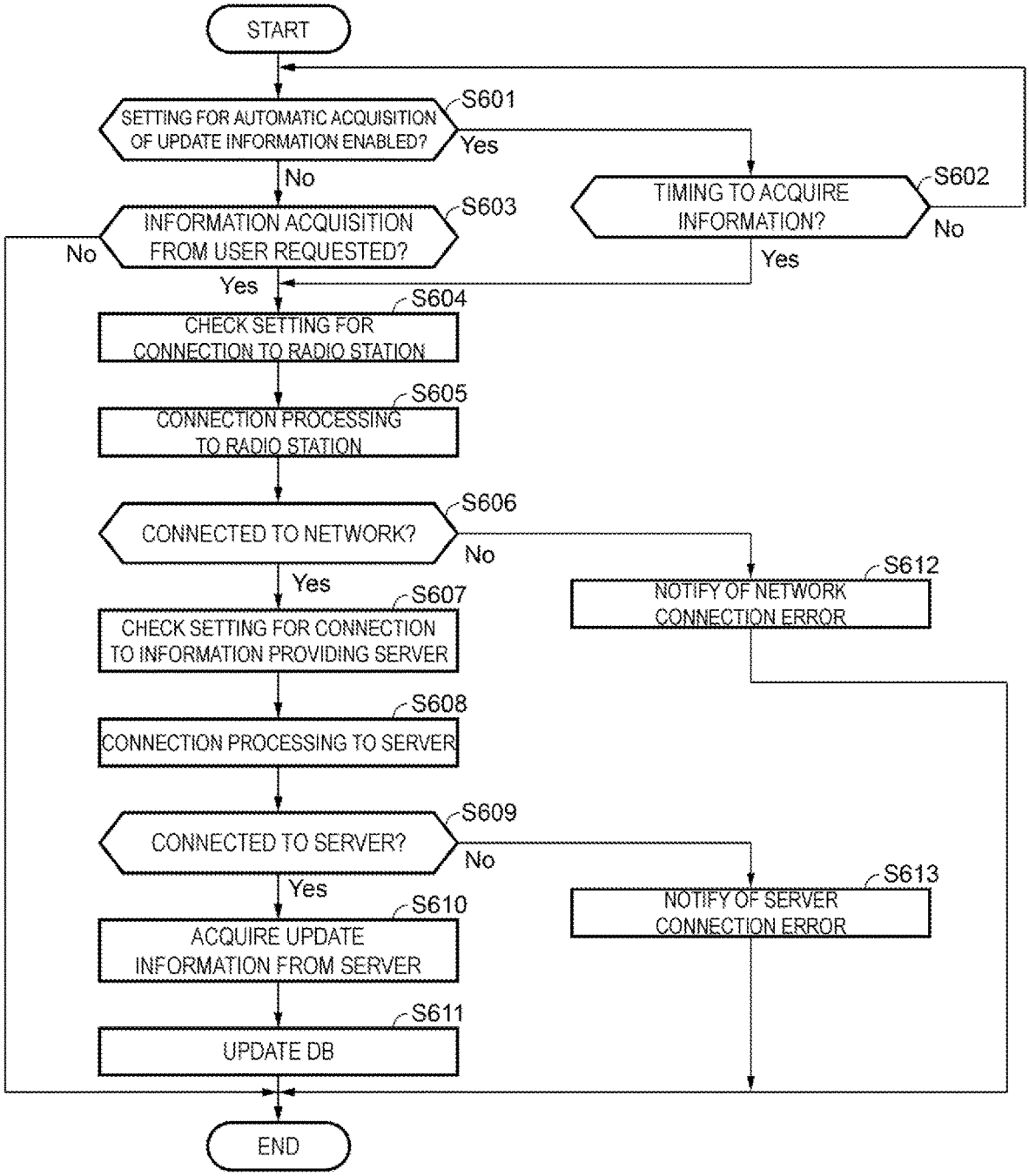
FIG. 11 is a flowchart illustrating a method for acquiring update information.

Referring to the flowchart in FIG. 11, an example of how the electronic timepiece 1 acquires update information, which is information for updating the database 41, from the information providing server 4 illustrated in FIG. 1. The update information is, for example, information replacing the database 41, information that changes a record in the database 41, a record added to the database 41, and the like.

In FIG. 1, for example, the radio station 2*a* is connected to the information providing server 4 via a network 5 such as the Internet. Specifically, the radio station 2*a* is connected to the network 5 via a router 6*a*, and the information providing server 4 is connected to the network 5 via a router 6*b*. In this case, the electronic timepiece 1 may be provided with information from the information providing server 4 via the radio station 2*a*.

First, in step S601, the update processing unit 33 determines whether setting for automatic acquisition of update information is enabled or not. In other words, the update processing unit 33 determines whether automatic acquisition of update information from the information providing server 4 is set or not. When the automatic acquisition setting is enabled, the update processing unit 33 proceeds the processing to step S602, and when the automatic acquisition setting is not enabled, proceeds the processing to step S603.

In step S602, the update processing unit 33 determines whether a current time is a timing for acquisition of update information or not. The timing can be set arbitrarily to, for example, a constant time interval, movement of the electronic timepiece 1, a timing of environmental change of the electronic timepiece 1 such as ambient sound or light, or the like. The update processing unit 33, when the current time is the timing for acquisition, proceeds the processing to step S604, and when the current time is not the timing for acquisition, returns the processing to step S601.

In step S603, the update processing unit 33 determines whether information acquisition is requested from the user or not. When the update processing unit 33 detects user operation requesting to acquire update information from the information providing server 4 from the operation unit 60, determines that information acquisition is requested, and proceeds the processing to step S604. The update processing unit 33, when not determining that information acquisition is requested, terminates the processing.

In step S604, the update processing unit 33 checks setting for connection to the radio stations 2. The setting for connection to the radio stations 2 is setting for establishing a communication link between the communication unit 10 and the radio stations 2. The setting for connection, for example, may be acquired by communication with the radio stations 2 by the communication unit 10, or may be recorded in association with the radio stations 2 in the database 41.

In step S605, the update processing unit 33 causes the communication unit 10 to perform a connection process to the radio stations 2. In other words, the communication unit 10 establishes a communication link with the radio stations 2, by mutual authentication with the radio stations 2, using the connection setting checked in step S604.

In step S606, the update processing unit 33 determines whether connection to the network 5 can be established by the connection processing in step S605 or not. For example, when the communication unit 10 can connect to the network 5 via the communication link established with the radio stations 2, the update processing unit 33 proceeds the processing to step S607. On the other hand, the update processing unit 33, when connection to the network 5 cannot be established, in step S612, notifies the user of a network connection error via the display unit 70, and terminates the processing. The network connection error may be notified, for example, by a handle of, the indicator unit 72, the small clock 78, or the like.

In step S607, the update processing unit 33 checks setting for connection to the information providing server 4. The setting for connection to the information providing server 4 is setting for establishing a communication link between the communication unit 10 and the information providing server 4. The setting for connection is, for example, stored in the storage unit 40 in advance.

In step S608, the update processing unit 33 causes the communication unit 10 to perform a connection process to the information providing server 4. In other words, the communication unit 10 establishes a communication link with the information providing server 4, by mutual authentication with the information providing server 4, using the setting for connection checked in step S607.

In step S609, the update processing unit 33 determines whether connection to the information providing server 4 can be established by the connection process in step S608. When the communication unit 10 can connect to the information providing server 4, by establishing a communication link with the information providing server 4, the update processing unit 33 proceeds the processing to step S610. On the other hand, the update processing unit 33, when connection to the information providing server 4 cannot be established, in step S613, notifies the user of a server connection error via the display unit 70, and terminates the processing. The server connection error may be notified, for example, by the handle of, the indicator unit 72, the small clock 78, or the like.

In step S610, the update processing unit 33 acquires update information from the information providing server 4. For example, the update processing unit 33 transmits, via the communication unit 10, a request message requesting update information in the database 41 to the information providing server 4. The information providing server 4 transmits update information in the database 41 to the electronic timepiece 1, as a response to the request message. Accordingly, the update processing unit 33 can acquire the update information from the information providing server 4 via the communication link between the communication unit 10 and the radio station 2.

In step S611, the update processing unit 33 updates the database 41, using the update information acquired in step S610. For example, the update processing unit 33 acquires a plurality of records in the database 41 as update information, overwrites records having duplicate identification information on the records of the update information, and adds the records having new identification information to the database 41. As described above, the electronic timepiece 1 can update the database 41 to a current state.

Note that, as the radio station 2*a* to which the electronic timepiece 1 is connected, a specific radio station in which information for connecting to the electronic timepiece 1 is stored in advance may be used. Thus, it is not necessary for the electronic timepiece 1 to acquire and retain a large number of pieces of connection information for an unidentified large number of radio stations in advance.

OTHER EXEMPLARY EMBODIMENTS

The present exemplary embodiment has been described, however, the present disclosure is not limited thereto. A configuration of each part may be substituted for any configuration having similar functionality, and within the technical scope of the present disclosure, any configuration in each exemplary embodiment may be omitted or added. Various alternative exemplary embodiments will now be apparent to those skilled in the art from these disclosures.

For example, in the exemplary embodiment described above, a configuration may be adopted in which the electronic timepiece 1 communicates with a radio terminal 7 as illustrated in FIG. 1. The radio terminal 7 is a communication terminal such as a mobile phone, a smart phone, a tablet terminal, a personal computer, or the like. For example, the communication unit 10 establishes a communication link with the radio terminal 7. The update processing unit 33 controls the communication unit 10 and the storage unit 40, so that contents of the database 41 are referred and edited by the user operating the radio terminal 7. In other words, the database 41 is referred and edited by the radio terminal 7, via the communication link between the communication unit 10 and the radio terminal 7. This allows the user to customize the contents of the database 41.

In addition, it goes without saying that the present disclosure includes various exemplary embodiments that are not described above, such as configurations in which the above-described configurations are applied to each other. The technical scope of the present disclosure is defined only by the disclosure specifying matters according to the claims that are valid from the foregoing description.

Contents derived from the exemplary embodiments described above will be described below, as aspects.

A first aspect is an electronic timepiece that includes a communication unit configured to receive identification information for identifying a radio station from the radio station, a storage unit configured to store a database having, as a record, the identification information and time difference information indicating a time difference associated with the identification information, a timekeeping unit in which a set time difference being a time difference with respect to a reference time is set, a first time difference correction unit configured to correct the set time difference to the time difference information associated with the identification information received by the communication unit, an operation unit configured to accept user operation, a second time difference correction unit configured to correct the set time difference in accordance with the operation, and an update processing unit configured to change the time difference information associated with the identification information received by the communication unit to the set time difference corrected by the second time difference correction unit, to update the database.

According to the first aspect, the database can be updated to a current state without having to acquire a record from an outside, by changing the time difference information in the database to a time difference that is corrected based on user input.

A second aspect is an electronic timepiece that includes a communication unit configured to receive identification information for identifying a radio station from the radio station, a storage unit configured to store a database having, as a record, the identification information and time difference information indicating a time difference associated with the identification information, a timekeeping unit in which a set time difference being a time difference with respect to a reference time is set, a first time difference correction unit configured to correct the set time difference to the time difference information associated with the identification information received by the communication unit, a positioning unit configured to use satellite signals received from a plurality of artificial satellites to calculate position information, a second time difference correction unit configured to correct the set time difference to a time difference identified from the position information, and an update processing unit configured to change the time difference information associated with the identification information received by the communication unit to the set time difference corrected by the second time difference correction unit, to update the database.

According to the second aspect, the database can be updated to a current state without having to acquire a record from an outside, by changing the time difference information in the database to a time difference that is corrected based on satellite positioning.

A third aspect is that, in the first or second aspect, when the identification information received by the communication unit is duplicate in the database, the first time difference correction unit identifies one of the records having the duplicate identification information based on predetermined priority.

According to the third aspect, even when duplicate identification information is present in the database, the first time difference correction unit does not stop and can continue operation. Also, by determining the priority in advance in accordance with credibility of a record, it is possible to improve credibility of time difference correction.

A fourth aspect is that, in the third aspect, the database has information indicating, as the priority, an order in which each of the plurality of records is updated.

According to the fourth aspect, by setting the order in which the record is updated as the priority, the priority in accordance with the credibility can be set to the record.

A fifth aspect is that, in the third aspect, the database has information indicating whether each of the plurality of records is updated by manual setting by the user or not, as the priority.

According to the fifth aspect, the priority of the record may be set in accordance with the credibility of the record and the user's needs.

A sixth aspect is that, in any one of the first to fifth aspects, the communication unit establishes a communication link with the radio station, and the update processing unit acquires update information for updating the database via the communication link with the radio station.

According to the sixth aspect, update information can be acquired from an outside using radio communication by the communication unit.

A seventh aspect is that, in any one of the first to sixth aspects, the communication unit establishes a communication link with a radio terminal, and the database is edited by the radio terminal via the communication link with the radio terminal.

According to the seventh aspect, the database can be edited by operating the radio terminal, using radio communication by the communication unit.

An eighth aspect, in any one of the first to seventh aspects, further includes a source display unit for displaying a source type used to correct the set time difference.

According to the eighth aspect, by displaying the source type of time difference correction, the user can check credibility of the source of the time differential correction.

A ninth aspect is that, in any one of the first to eighth aspects, the database has radio station position information associated with the identification information, and indicating a position of the radio station, the storage unit stores a time zone table having time difference information for each of a plurality of regions, and the first time difference correction unit, based on the radio station position information associated with the identification information received by the communication unit, identifies the time difference information from the time zone table, and corrects the set time difference to the time difference information identified from the time zone table.

According to the ninth aspect, even when there is no time difference information in the database, time difference information can be identified from the time zone table using the radio station position information.

What is claimed is:

1. An electronic timepiece, comprising:

a communication unit configured to receive identification information for identifying a radio station from the radio station;

a storage unit configured to store a database having, as a record, the identification information and time difference information indicating a time difference associated with the identification information;

a timekeeping unit in which a set time difference, that is a time difference with respect to a reference time, is set;

a first time difference correction unit configured to correct, based on the identification information received by the communication unit and the database, the set time difference to the time difference information associated with the identification information received by the communication unit;

an operation unit configured to accept user operation;

a second time difference correction unit configured to correct the set time difference in accordance with the operation; and an update processing unit configured to, in response to the second time difference correction unit correcting the set time difference in accordance with the operation, (i) acquire the identification information received by the communication unit and (ii) update the database by changing the time difference information associated with the identification information received by the communication unit using the set time difference as corrected by the second time difference correction unit.

2. The electronic timepiece according to claim 1, wherein when the identification information received by the communication unit is duplicate in the database, the first time difference correction unit identifies, based on predetermined priority, one of a plurality of the records having the duplicate identification information.

3. The electronic timepiece according to claim 2, wherein the database includes, as the priority, information indicating an order in which each of the plurality of records is updated.

4. The electronic timepiece according to claim 2, wherein the database has, as the priority, information indicating whether each of the plurality of records is updated by manual setting by a user.

5. The electronic timepiece according to claim 1, wherein the communication unit establishes a communication link with the radio station, and the update processing unit acquires update information for updating the database via the communication link with the radio station.

6. The electronic timepiece according to claim 1, wherein the communication unit establishes a communication link with a radio terminal, and the database is edited by the radio terminal via the communication link with the radio terminal.

7. The electronic timepiece according to claim 1, further comprising a source display unit configured to display a source type used to correct the set time difference.

8. The electronic timepiece according to claim 1, wherein the database has radio station position information associated with the identification information, and indicating a position of the radio station, the storage unit stores a time zone table having time difference information for each of a plurality of regions, and the first time difference correction unit, based on the radio station position information associated with the identification information received by the communication unit, identifies the time difference information from the time zone table, and corrects the set time difference to the time difference information identified from the time zone table.

9. An electronic timepiece, comprising:

a communication unit configured to receive identification information for identifying a radio station from the radio station;

a storage unit configured to store a database having, as a record, the identification information and time difference information indicating a time difference associated with the identification information and to store a time zone table having region information and time difference information for each of a plurality of regions;

a timekeeping unit in which a set time difference, that is a time difference with respect to a reference time, is set;

a first time difference correction unit configured to, based on the identification information received by the communication unit and the database, correct the set time difference to the time difference information associated with the identification information received by the communication unit;

a positioning unit configured to use satellite signals received from a plurality of artificial satellites to calculate position information;

a second time difference correction unit configured to correct the set time difference to a time difference identified from the position information based on the time zone information; and an update processing unit configured to (i) acquire the identification information received by the communication unit and (ii) update the database by changing change the time difference information associated with the identification information received by the communication unit using the set time difference as corrected by the second time difference correction unit.

10. The electronic timepiece according to claim 9, wherein when the identification information received by the communication unit is duplicate in the database, the first time difference correction unit identifies, based on predetermined priority, one of a plurality of the records having the duplicate identification information.

11. The electronic timepiece according to claim 10, wherein the database has information indicating, as the priority, an order in which each of the plurality of records is updated.

12. The electronic timepiece according to claim 10, wherein the database has information indicating, as the priority, whether each of the plurality of records is updated by manual setting by a user.

13. The electronic timepiece according to claim 9, wherein the communication unit establishes a communication link with the radio station, and the update processing unit acquires update information for updating the database via the communication link with the radio station.

14. The electronic timepiece according to claim 9, wherein the communication unit establishes a communication link with a radio terminal, and the database is edited by the radio terminal via the communication link with the radio terminal.

15. The electronic timepiece according to claim 9, further comprising a source display unit configured to display a source type used to correct the set time difference.

16. The electronic timepiece according to claim 9, wherein the database has radio station position information associated with the identification information, and indicating a position of the radio station, the storage unit stores a time zone table having time difference information for each of a plurality of regions, and the first time difference correction unit, based on the radio station position information associated with the identification information received by the communication unit, identifies the time difference information from the time zone table, and corrects the set time difference to the time difference information identified from the time zone table.

17. A control method of an electronic timepiece including a storage unit configured to store a database having a plurality of records, each record having identification information for identifying a radio station and time difference information indicating a time difference associated with the identification information; and a display unit configured to display a time based on a set time difference that is a time difference with respect to a reference time;

the control method comprising:

receiving identification information from a radio station;

executing a first time difference correction process that corrects, based on the received identification information and the database, the set time difference to the time difference information associated with the received identification information;

accepting user operation;

executing a second time difference correction process that corrects the set time difference in accordance with the operation; and in response to correcting the set time difference in accordance with the operation, (i) acquiring the identification information received from the radio station and (ii) updating the database by changing the time difference information associated with the received identification information using the set time difference as corrected by the second time correction process.

* * * * *